United States Patent [19]

Berg

[11] 3,934,440

[45] Jan. 27, 1976

[54] MEANS AND METHOD OF FORMING SHEET METAL

[76] Inventor: John W. Berg, 1111 Morse Ave., Space 35, Sunnyvale, Calif. 94086

[22] Filed: Sept. 4, 1973

[21] Appl. No.: 394,280

Related U.S. Application Data

[63] Continuation of Ser. No. 145,397, May 20, 1971, abandoned.

[52] U.S. Cl. ..... 72/54; 72/350; 72/351

[51] Int. Cl.[2] ..... B21D 26/04

[58] Field of Search ..... 72/54, 57, 60, 61, 62, 72/350, 351; 29/421

[56] References Cited

UNITED STATES PATENTS

| | | | |
|---|---|---|---|
| 1,970,134 | 8/1934 | Ferris | 72/351 |
| 2,284,773 | 6/1942 | Sivian et al. | 72/60 |
| 2,348,921 | 5/1944 | Pavlecka | 72/63 |
| 2,649,067 | 8/1953 | Kranenberg | 72/350 |
| 2,728,317 | 12/1955 | Clevenger et al. | 29/421 |
| 3,031,993 | 5/1962 | Gerard et al. | 72/54 |
| 3,166,837 | 1/1965 | Frick et al. | 29/421 |
| 3,177,689 | 4/1965 | Christian et al. | 72/56 |
| 3,285,045 | 11/1966 | Berg | 72/54 |
| 3,373,585 | 3/1968 | Reynolds | 72/57 |
| 3,420,089 | 1/1969 | Myers | 72/351 |
| 3,566,650 | 3/1971 | Johnson | 72/63 |
| 3,668,914 | 6/1972 | Voitsekhovsky et al. | 72/57 |

FOREIGN PATENTS OR APPLICATIONS

| | | | |
|---|---|---|---|
| 213,959 | 6/1941 | Switzerland | 72/351 |
| 115,957 | 9/1942 | Australia | 72/54 |
| 172,264 | 9/1965 | U.S.S.R. | 72/54 |

*Primary Examiner*—Milton S. Mehr
*Attorney, Agent, or Firm*—Lyon & Lyon

[57] ABSTRACT

A means of and method of forming sheet metal by use of fluid pressure wherein an initially flat sheet metal work piece is placed on a backing plate with its margins clamped between the plate and a peripheral clamping ring. The clamping ring is clamped against the margin of the work piece by a plurality of fluid operated clamping units. the side of the work piece opposite from the backing plate and within the clamping ring is free to expand or distend without restraint except that provided by the metal comprising the work piece itself. Pressure fluid is introduced between the metal work piece and its backing plate to cause the work piece to distend away from the backing plate. A set of freely movable feeler strips engage the edge of the work piece at spaced points. The feeler strips control sensing units which, in turn, control the pressure exerted by the clamping units so as to permit predetermined slippage of the margin of the work piece with respect to the clamping rings.

If the dimensions of the work piece are critical and the undulated zone of the work piece is within the boundaries of the finished product, the work piece is placed on the same or second backing plate so that the margins of the work piece are between the backing plate and a clamping ring of predetermined increased internal dimension to clear the periphery of the distended portion of the work piece. A forming die overlies and clears the distended work piece and is joined at its periphery to the clamping ring. After removing air from the distended work piece, pressure fluid is applied to further distend the work piece, eliminating the undulations and presses the work piece into conformity with the die while its margin is clamped against slippage.

One embodiment of the means and method includes a valve sensitive to the pressure of the pressure fluid for varying the pressure in the clamp units in proportion to the change in pressure required to form the work piece as the work piece changes its shape.

Another embodiment utilizes a deformable membrane, which may be a second work piece, in place of the backing plate. A further embodiment involves the sandwiching of the part to be formed between sheets of expendable sheets. A still further embodiment includes the use of pressure fluid, heated or cooled to temperatures at which the forming of the metal is enhanced.

5 Claims, 16 Drawing Figures

INVENTOR.
JOHN W. BERG
BY
Lyon & Lyon
ATTORNEYS

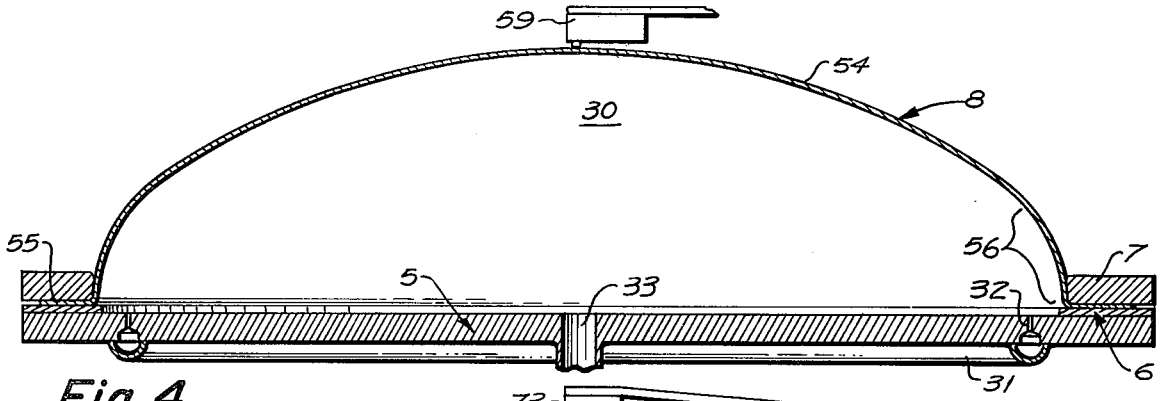
Fig. 4
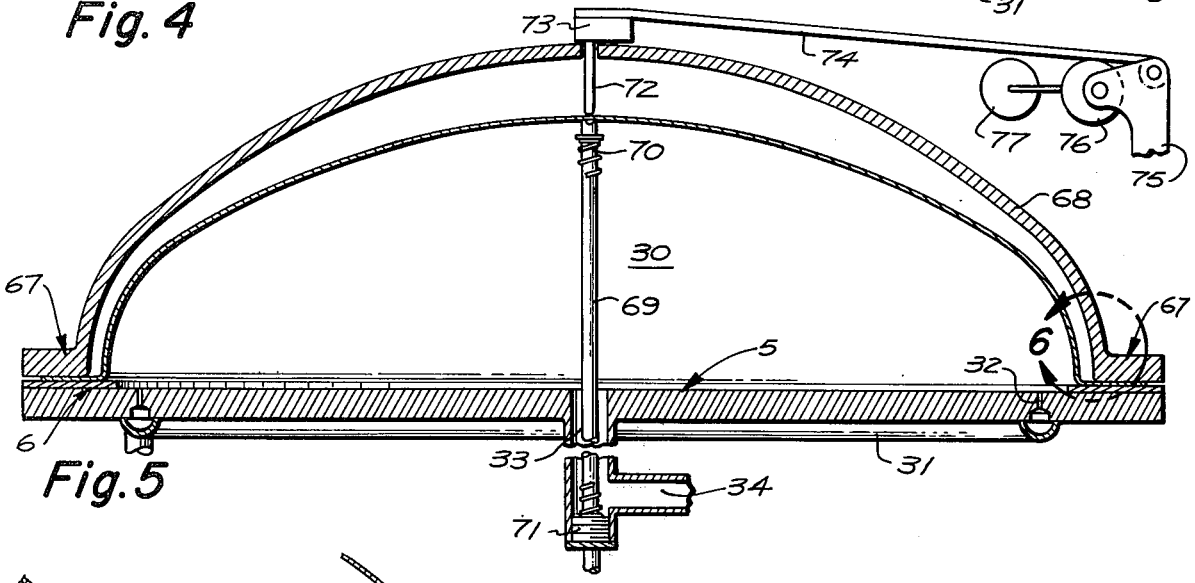
Fig. 5
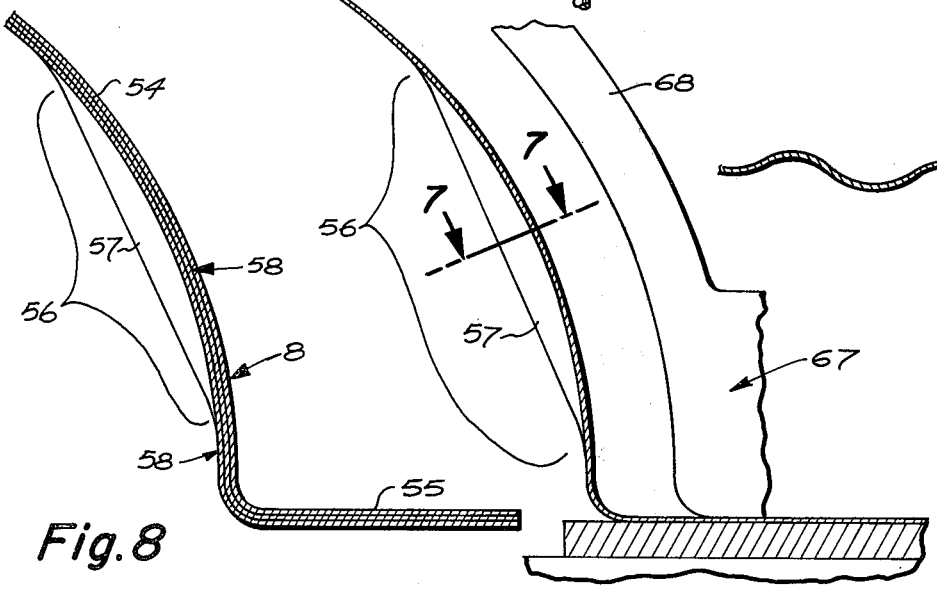
Fig. 8
Fig. 6
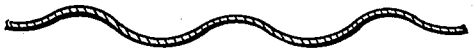
Fig. 7
INVENTOR.
JOHN W. BERG
BY
Lyon & Lyon
ATTORNEYS INVENTOR.
JOHN W. BERG
BY
Lyon & Lyon
ATTORNEYS

INVENTOR.
JOHN W. BERG
BY
ATTORNEYS

INVENTOR.
JOHN W. BERG

BY

Lyon & Lyon
ATTORNEYS

MEANS AND METHOD OF FORMING SHEET METAL

RELATED CASES

This application is a continuation of U.S. application Ser. No. 145,397 filed May 20, 1971 and now abandoned.

BACKGROUND OF THE INVENTION

Shaping of sheet metal has been accomplished by applying pressure to the central portion of a sheet metal work piece while the work piece is overlying a backing disc and secured by a peripheral clamp ring so as to cause the central portion of the work piece to distend outwardly into a dome-shaped product. The operation has been repeated in stages, as shown in U.S. Pat. No. 3,285,045, in order to increase the depth of the dome. A material limitation in this method, or the apparatus used to perform this method, has been the work hardening of the narrow zone adjacent the secured margins, or zones if the shaping is done in stages, with the attendant need of annealing the work piece between operations.

Attempts have been made to permit some slippage of the clamped margin, which tends to increase the area subject to work hardening and to reduce the amount of work hardening per unit area. However, control over such slippage has been too erratic to produce favorable results.

SUMMARY OF THE INVENTION

The present invention is directed to a means and method of shaping sheet metal utilizing pressure fluid which is summarized in the following objects:

First, to provide a means and method of shaping sheet metal wherein the margins of the sheet metal work piece are clamped by a force which may be varied to permit controlled slippage of the margin as the central portion of the work piece is shaped by pressure fluid.

Second, to provide a means and method, as indicated in the preceding object, which incorporates a novel means and method wherein inward slipping of the margins of the work piece is detected and caused to control the clamping force in the corresponding region so as to obtain equal slipping around the periphery of the work piece, if the work piece is an essentially true circle, or to permit predetermined differences in the amount of slippage if the work piece is asymmetrical.

Third, to provide a means and method, as indicated in the other objects, whereby the area subject to work hardening is materially increased with corresponding reduction in the amount of work hardening occurring in any unit area.

Fourth, to provide a means and method, as indicated in the other objects, which is capable of producing large parts, for example, several feet, or even many feet, in diameter, while maintaining extreme accuracy, the work piece undergoing an initial forming operation while free of constraint, except for its clamped margins which are permitted to slip, then undergoing a final forming operation wherein the work piece is further stretched a limited distance into conformity with a fixed shaping die.

Fifth, to provide a means and method of shaping sheet material wherein the pressure fluid, preferably a liquid, is circulated during the forming operation, thus, by heating or cooling the pressure fluid, the work piece may be maintained at the most optimum temperature.

Sixth, to provide a means and method of shaping sheet material wherein the supply of pressure fluid may be controlled to predetermine the rate at which the work piece is distended even to the point that advantage may be taken of the "creep" characteristics of the material as well as its "stretch" characteristics.

DESCRIPTION OF THE DRAWINGS

FIG. 4 is an enlarged sectional view, taken through 4—4 of FIG. 1, showing the backing plate and clamping rings with a work piece in its distended condition.

FIG. 5 is a sectional view, similar to FIG. 4, showing the distended work piece within a die shell for further distention.

FIG. 6 is a further enlarged fragmentary sectional view, taken within Circle 6 of FIG. 5, showing the marginal zone of the distended work piece and adjacent portions of the clamping rings and die shell.

FIG. 7 is a fragmentary sectional view of a work piece, taken through 7—7 of FIG. 6.

FIG. 8 is an enlarged fragmentary sectional view of a work piece, corresponding to FIG. 6, but showing extendable cover sheets on opposite sides of a work piece.

Figure 1:
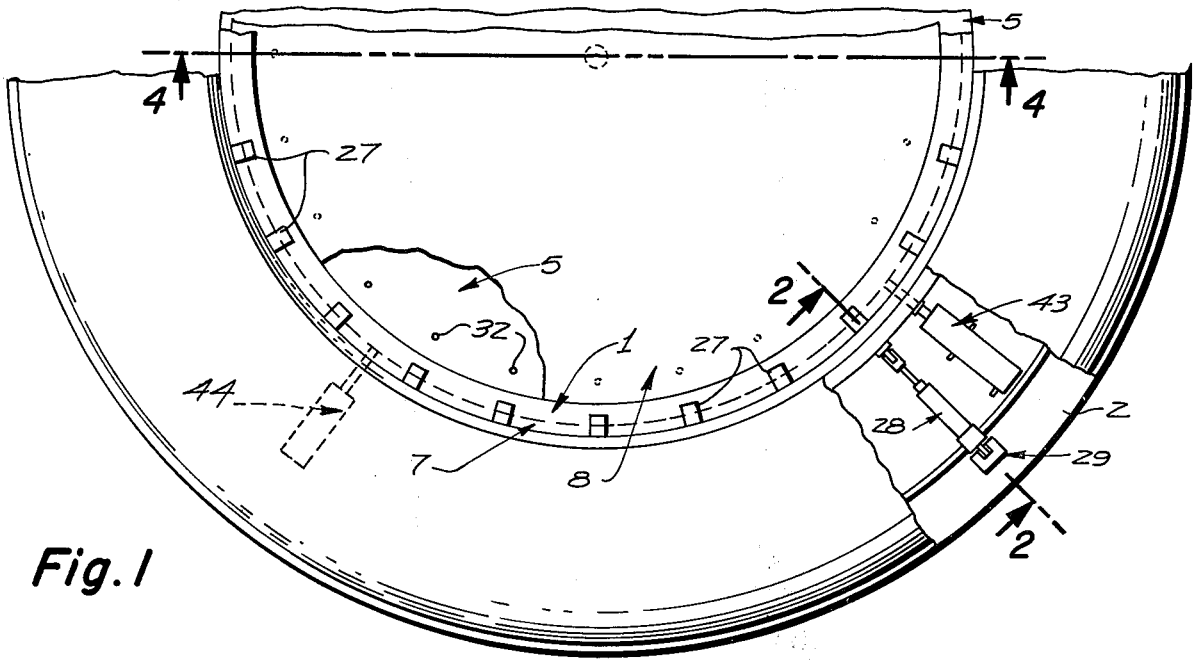
FIG. 1 is a fragmentary plan view, showing one embodiment of the means for forming sheet metal.

The means for forming sheet metal includes an essentially cylindrical mounting ring 1, encompassing the area in which the forming operation occurs. The mounting ring is provided intermediate its ends with a radially outwardly extending mounting flange 2, dividing the mounting ring into an upper portion 4 and a lower portion 3.

Slidably disposed within the mounting ring is a backing plate 5, the periphery of which removably supports a lower marginal clamping ring 6 and an upper clamping ring 7, between which is received the margin of a sheet metal work piece 8.

The lower portion 3 of the mounting ring 1 is provided with a ring of depending mounting brackets 9, arranged in pairs, connected by pivot pins 10, each of which pivotally supports a lever 11. Each lever is provided with a thrust knob 12 and a radially outwardly directed elongated lever arm 13. The thrust knob 12 is provided with an upwardly directed socket 14, which journals the end of a corresponding thrust lever 15, the upper end of which receives a pivot pin 16, which is journaled in a clevis bracket 17, secured to the underside of the backing plate, adjacent its periphery. The ring of clevis brackets 17 and thrust levers 15 thus provided support the backing plate.

The radially outer end of each lever arm 13 is joined by a pair of link members 18 to a corresponding mounting clevis 19, secured to the underside of the mounting flange 2. The link members are connected to each other and to the lever arm 13 and mounting clevis 19 by pivot pins 20. Located above each lever arm 13 is a double acting thrust unit 21, one end of which is pivotally connected to a mounting clevis 22, secured to the lower portion 4 of the mounting ring 1. The thrust unit 21 is preferably hydraulically operated, but may be pneumatically operated. The other end of the thrust unit is provided with an operating shaft 23, which is joined by a pivotal connection 24 to a lever arm 25, extending from one of the link members 18.

Figure 2:
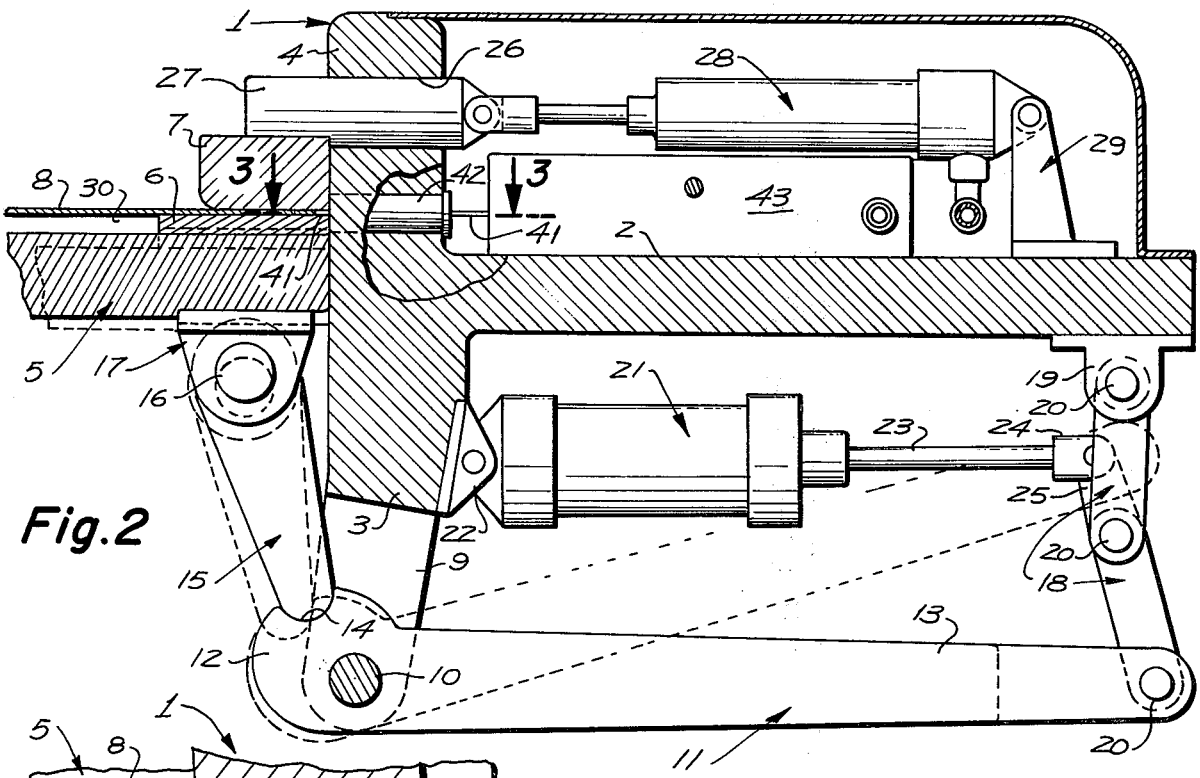
FIG. 2 is an enlarged fragmentary sectional view, taken through 2—2 of FIG. 1, showing particularly one of the clamping units.

Disposed vertically above each lever 11, in the upper portion 4 of the mounting ring 1, is a radial guide bore 26, which receives a slide bar 27. When each slide bar is in its radially inward position, as shown in FIG. 2, the upper clamping ring 7 is restrained against upward movement, and when the slide bar is retracted radially outward, the clamping rings 6 and 7, as well as the work piece 8, may be removed or installed. Each slide bar is moved by a thrust unit 28, which may be single acting; that is, the slide bar may be retracted by spring action. The radially outer end of each thrust unit is supported by a mounting bracket 29.

As it is apparent from FIG. 2, the force exerted by each hydraulic thrust unit 21 is multiplied so that a substantial clamping force is applied by each hydraulic unit in an upward direction when the upper clamping ring 7 is restrained by the set of slide bars 27. Each thrust unit 21, and associated links and levers, as well as the corresponding slide bar and the portion of the mounting ring 1 between each slide bar 27 and lever 11 forms a clamping unit of which the inner end of the slide bar and the corresponding clevis bracket 17 form clamping terminals. It is contemplated that a large number of clamping units be arranged about the work piece. In the construction illustrated, the clamping units are indicated as separated by 15°, thus indicating a total of 24 clamping units.

The embodiment shown in FIGS. 1 and 2 is intended for the forming of a dome-shaped product from an initially flat sheet metal work piece. The diameter of the dome depends upon the internal diameter of the upper clamping ring 7, thus, by changing the internal diameter of the clamping ring, products of different diameters may be formed.

Figure 13:
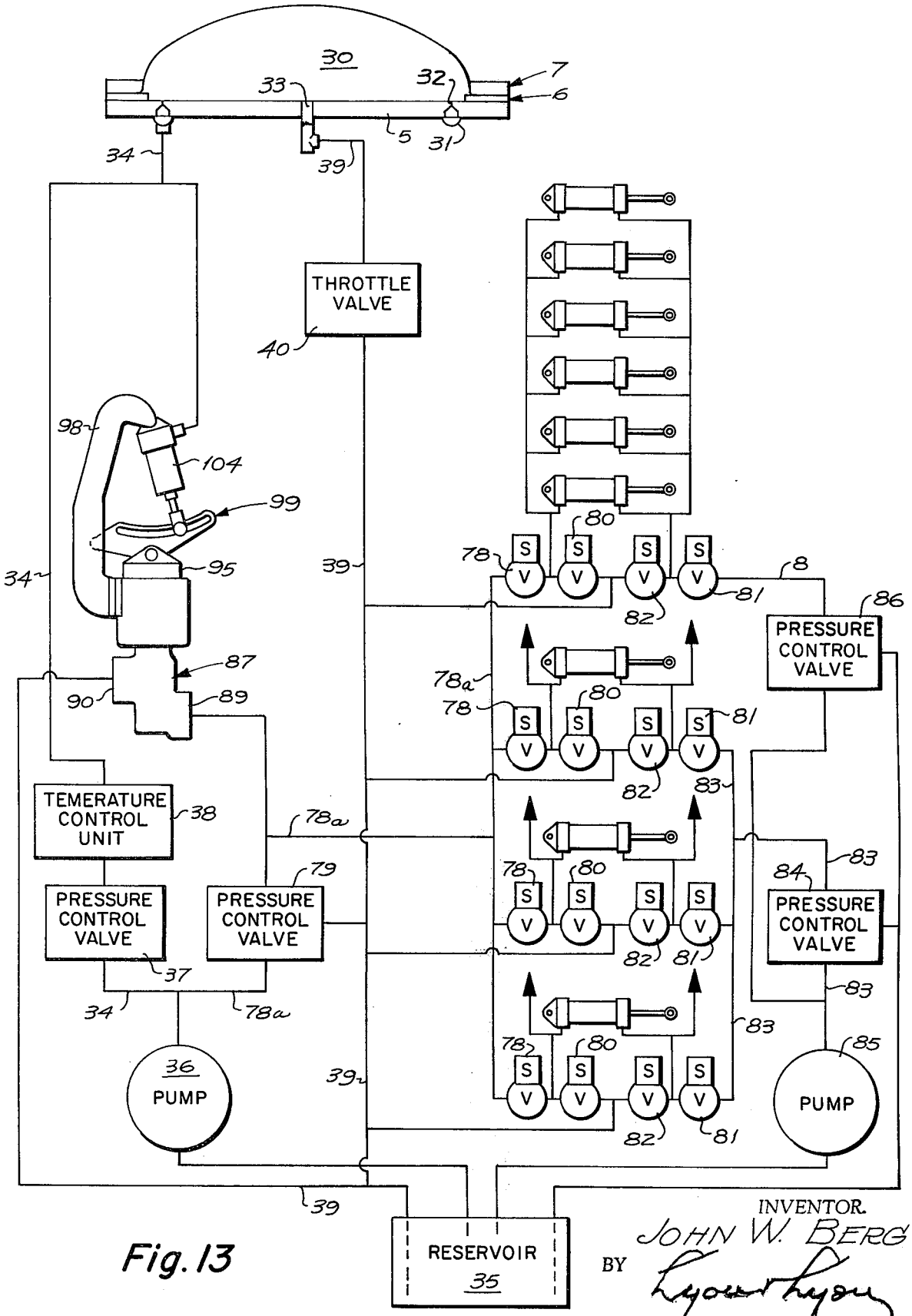
FIG. 13 is a diagrammatical view, showing the hydraulic or pneumatic components.

Referring to FIG. 4, and the diagrammatical view FIG. 13, the space between the backing plate 5 and the work piece 8 forms a pressure chamber 30. Under the backing plate 5 is a circular pressure fluid supply manifold 31, communicating with a ring of inlet ports 32, the diameter of which is determined by the minimum size of the product to be formed. The backing plate is also provided with a central outlet port 33. A pressure line 34 extends from a reservoir 35 through a pump 36 and pressure control valve 37 to the manifold 31. A temperature control unit 38 may be interposed between the valve 37 and the manifold 31. A return or drain line 39, having a throttle valve 40, extends between the outlet port 33 and the reservoir 35.

By applying fluid under controlled pressure to the pressure chamber 30, the central portion of the work piece within the clamping ring 7, is caused to distend, as suggested in FIG. 4. It is preferred to use a liquid as the pressure fluid to avoid an explosive effect if the work piece should rupture. However, for some forming operations, a gaseous pressure fluid may be used. It is essential to the means and method herein disclosed for forming sheet metal, that the margin of the work piece slip radially inward between the opposed clamping faces a controlled amount as the central portion of the work piece is distended. This is accomplished by sensing the position of the edge of the work piece at selected stations and utilizing this information to control the clamping pressure of a corresponding group of clamping units by regulating the pressure in their corresponding thrust units 21.

Figure 3:
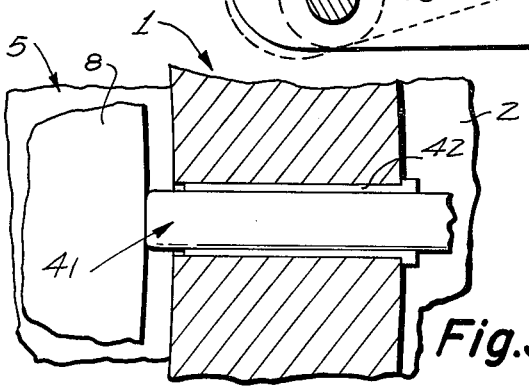
FIG. 3 is a further enlarged fragmentary sectional view, taken through 3—3 of FIG. 2, showing one of the sensing elements.
Figure 9:
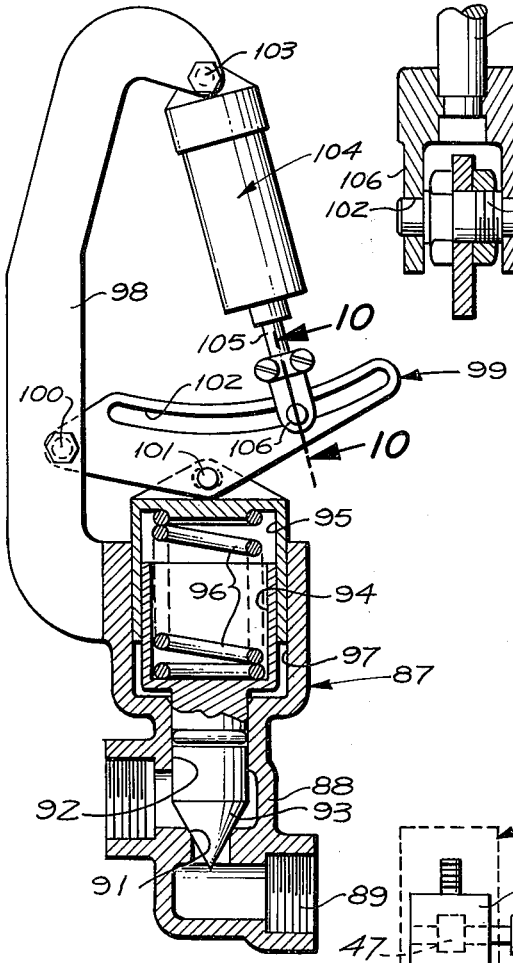
FIG. 9 is a longitudinal sectional view of the clamping pressure augmenting valve.
Figure 10:
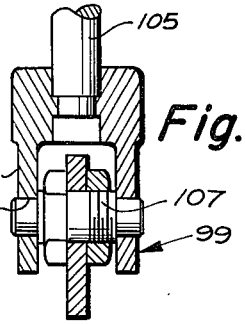
FIG. 10 is an enlarged sectional view, taken through 10—10 of FIG. 9.
Figure 12:
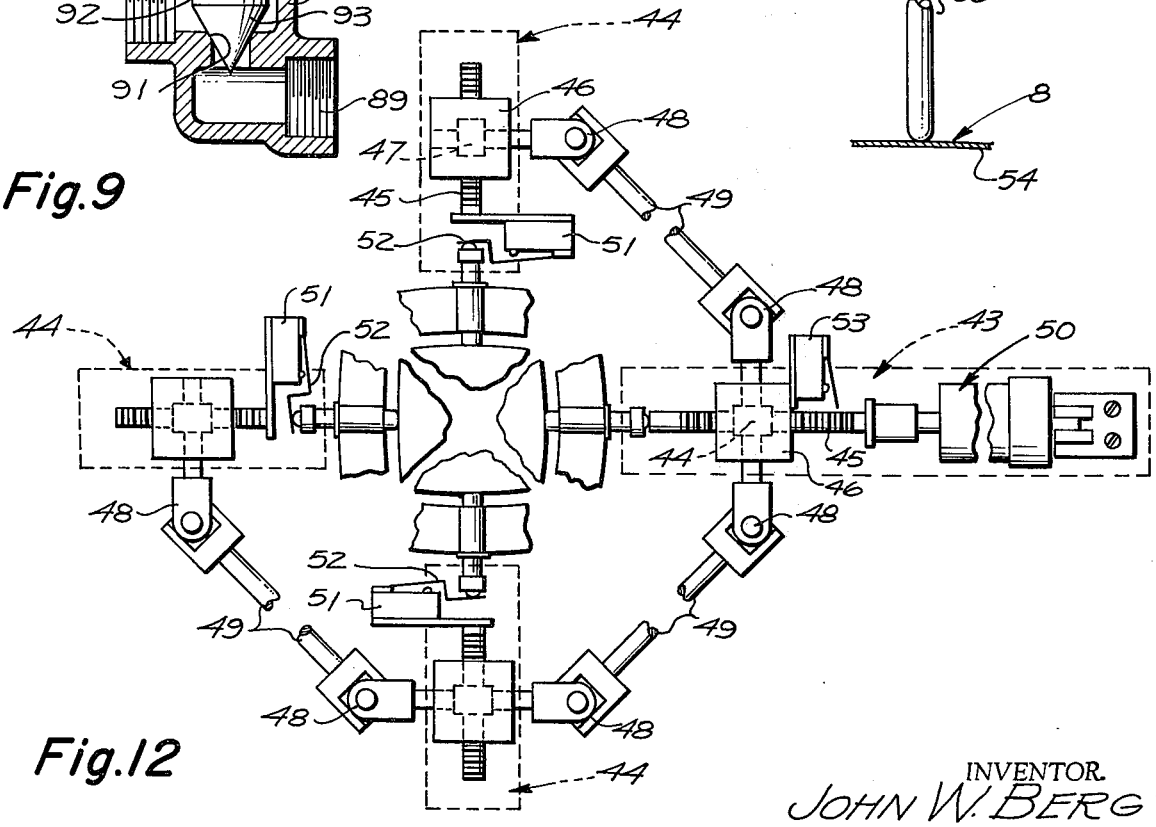
FIG. 12 is a schematic plan view, showing the mechanism for sensing contraction of the work piece during the forming operation.

With reference to FIGS. 2, 3 and 12, a set of sensing strips 41, of lesser thickness than the sheet metal work piece 8, extend through guide sleeves 42 provided in the upper portion 3 of the mounting ring 1. For purposes of illustration, four such sets of sensing strips are indicated, each controlling a flanking group of clamping units, in the construction illustrated, three on each side. Referring to FIG. 12, one sensing strip forms a part of a master control assembly 43, whereas, each remaining sensing strip forms a part of a corresponding slave control assembly 44.

Each control assembly 43 or 44 includes a rack member 45, extending through a gear housing 46, and engaging a gear 47. The gears 47 are connected by universal joints 48 and connecting rods 49 to the other control assembly so that the rack members move radially inward in unison.

The master control assembly 43 includes a thrust unit 50, which may be pneumatic or hydraulic, and includes a retraction spring, not shown. During operation, the thrust unit 50 maintains sufficient force against the corresponding sensing strip 41 to maintain it in contact with the edge of the work piece 8; the force required is nominal. The corresponding group of clamping units are preadjusted to permit a predetermined slippage. Tests have shown that such slippage can be predetermined within reasonable tolerance.

Interposed between the rack member of each slave control assembly 44 is a double pole switch 51 and a spring arm 52. As will be described more specifically hereinafter, each double pole switch 51 controls through solenoid valves its corresponding group of clamping units so as to relax the clamping force if the sensing strip indicates less movement than at the station sensed by the master control assembly, and increases the clamping force if a greater movement is detected. As the slipping movement need not continue throughout the forming operation, slippage of the work piece margin may be terminated at any time by means of a limit switch 53, associated with the master control assembly 43, which operates the solenoid valves to effect full clamping force by all of the clamping units.

Referring to FIG. 4, the work piece during the forming operation produces a distended portion 54 and a marginal flange 55, which, as indicated previously, diminishes in width as the work piece is distended. The inward movement of the marginal portion of the work piece produces a peripheral zone 56, adjacent the flange, in which may be formed undulations 57, as in FIGS. 6 and 7. The undulations are readily eliminated in a subsequent operation to be described. If the margin of the work piece were firmly clamped, high stress concentrations will occur at the junction between the distended portion and the flange.

By permitting controlled slippage, the increased stress is distributed throughout the zone 56 so that the unit stress is much less than would otherwise be the case. This is particularly important when forming metals which are not capable of withstanding high elongation; that is, localized, high stress produces localized excessive elongation; however, this is avoided by distributing the stress throughout the zone 56 and is readily maintained at an acceptable level. Tests have indicated that many of the so called exotic metals may be formed by the means and method herein described into shapes which were not otherwise capable of being produced. For example, test parts of titanium have been successfully produced.

In the forming of parts in which the surface finish is of primary importance and to further reduce the stress in the finished part, it has been feasible to cover the work piece with expendable cover sheets 58, as shown in FIG. 8. These cover sheets may be formed of aluminum or other low cost material.

Referring again to the control of the clamping force applied to the margin of the work piece, a limit switch 59 may be suitably supported above the center of the work piece for engagement when the work piece has been distended a predetermined distance. The limit switch 59 may serve the same purpose as the limit switch 53, or, may come into operation after the limit switch 53. In either case, the limit switch 59 terminates the forming operation by shutting off the supply of pressure fluid.

Figure 11:
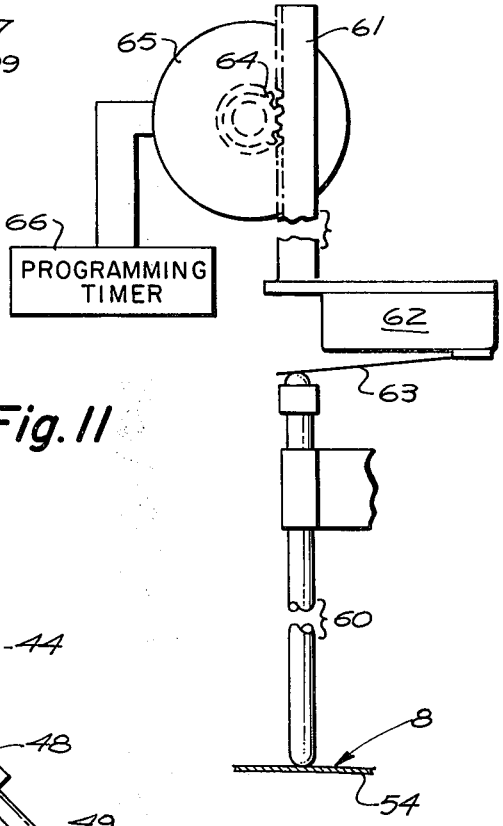
FIG. 11 is a schematic view, showing a means for sensing extension of the work piece for the purpose of controlling the supply of pressure fluid.

The rate at which the pressure fluid is supplied at various stages of the forming operation often affects the properties of the final product. For example, the initial portion of the forming operation may proceed more rapidly than the final stages of the forming operation. The forming rate may be varied by controlling the output of the pump 36, or by controlling the output pressure of the fluid passing the control valve 37. To accomplish this purpose, a sensing means, such as shown in FIG. 11, may be utilized. The sensing means includes a probe rod 60, which rests on the center of the work piece. Above the probe is a rack 61, carrying a double pole switch 62 and leaf spring 63, the latter engageable by the probe 60. The rack is driven by a gear 64, which in turn is driven by a motor 65, the speed of which is governed by a programming timer 66. The switch 62 operating through solenoid valves increases or decreases the supply of pressure fluid as the probe and rack increase or decrease the distance therebetween.

In this regard, it should be noted that the master control assembly 43 is essentially a programming timer, and that an extraneous programming timer analagous to the arrangement indicated in FIG. 11 may be adapted to control marginal slippage of the work piece 8.

Reference is now directed to FIGS. 5 and 6 which illustrate the means and method whereby the work piece in the condition shown in FIG. 4 may be arranged for further distention to its final form. This is accomplished by using a final clamping ring 67 of larger diameter than the clamping ring 7. Also, in this case, the clamping ring 67 is provided with a die shell 68, the inner surface of which defines the final shape of the work piece. If a liquid pressure fluid is utilized, it is essential that air be removed from the initially distended work piece. This may be accomplished by a bleed tube 69, mounted in the central outlet port 33. The bleed tube is notched at its upper end and is urged upwardly by a spring 70. The lower end of the bleed tube extends through a packing gland 71, which at least under conditions of low pressure, permits the spring to hold the bleed tube 69 against the crown of the distended work piece. As the pressure fluid enters the air is driven out. When pressure fluid is detected in the bleed tube, the bleed line attached thereto is closed.

A sensing device, such as shown in FIG. 11, may be utilized to sense the distention of the work piece toward the die shell 68. Alternatively, another embodiment of the sensing means, indicated diagrammatically in FIG. 5, may be utilized. This embodiment includes a probe 72, which engages a double pole sensing switch 73, mounted on a lever arm 74, suitably supported on a bracket 75. The lever arm is raised by a control cam 76, operated by a drive motor 77. It has been found that an eccentric cam arranged so that the effective movement decreases as the work piece approaches the die shell provides the desired programming in most cases. However, a programming timer may be utilized to control the speed of the motor 77 if a different programming is desired.

It has been found that the accelerated rise in pressure as the work piece conforms to the die shell may be utilized to terminate the forming operation by shutting off the pump or the supply line. It has also been found that this rise in pressure may be detected at its early stages so as to minimize the force exerted against the die shell by the work piece, thus, enabling the die shell to be formed of relatively low strength material. In fact, a die shell of molded fiber glass has been found acceptable.

The undulations 57 serve a useful function, for when the work piece is further distended to the surface of the die shell 68, they reduce the amount of stretch or elongation which would otherwise occur in the metal. With regard to FIG. 8, it should be noted that the expendable cover sheets 58 are removed before the work piece is subjected to its final forming operation.

In the forming of some metals, particularly those which have a minimum amount of springback, the second stage may be omitted and the die shell 68 may be made a part of the clamping ring 7. In such case, any undulations occurring during the forming operation are eliminated as the forming operation is completed.

Reference is directed to FIG. 13, a portion of which illustrates diagrammatically a typical control for the clamping units. The thrust units of each group of clamping units is simultaneously controlled by thrust control valves 78, connected by a supply line **78*a* in parallel with a pressure control valve 79, supplied by the pump 36. A set of drain valves 80 companion to the control valve 78, connect the thrust units to the reservoir 35**.

It is preferred to control the clamping pressure by providing control valves operating on the return or retraction side of the thrust units, rather than adjust the pressure at the thrust or extension side of the thrust units. Connected to the thrust units of each group of clamping units is a solenoid operated back pressure or return control valve 81, and a solenoid drain valve 82. The back pressure control valves operated by the slave control assembly 44 are connected by a supply line 83 through a pressure control valve 84 to a pump 85. It is preferred to use a second pump; however, the pump 36 may be used.

Interposed between the pair of valves 81 and 82, corresponding to the group of clamping units controlled by the master control assembly 43 is an adjustable pressure control valve 86 so that the pressure of this group of clamping units may be adjusted to exert a predetermined but constant clamping force.

The force required to distend the work piece increases as the work piece distends toward its final shape. Consequently, the pressure of the pressure fluid increases during the forming operation. The amount of the increase varies with the intended shape of the final product and also with the type of metal being formed. In some cases, the metal tends to work harden, increasing its resistance to the pressure fluid.

If the change in required pressure is substantial, the force tending to draw in the margins of the work piece increases as the work piece is distended. In such cases, it is necessary to increase the clamping pressure to compensate for the increased tendency of the margins of the work piece to slip. Compensation may be affected by programming the master and slave control assemblies 43 and 44; it is preferred, however, to accomplish such compensation by utilizing the change in pressure of the pressure fluid itself. This is accomplished by the clamping pressure augmenting valve 87. This valve includes a valve body 88, having an inlet port 89 and a drain port 90, separated by a valve seat 91, aligned with a bore 92, having a slidable valve member 93 which engages the valve seat. The valve member is provided with a spring cup 94, received in a mating converted spring cup 95. The spring cups receive a spring 96.

The spring cups are received in a counter bore 97, at one side of which a bracket 98, from which is pivotally supported a thrust lever 99 by means of a pivotal connection 100. A second pivotal connection 101 joins the thrust lever to a boss provided on top of the inverted spring cup 95. The thrust lever is provided with an arcuate slot 102.

The bracket 98 extends above the thrust lever and terminates in a hook portion, having a pivotal connection 103, joined to a thrust unit 104. The axis of the pivotal connection 103 is located approximately at the center defined by the arcuate slot 102. The thrust unit 104 is provided with a shaft 105, joined by a pivotal connection 106 to an adjustment bolt 107 received in the arcuate slot and capable of being adjusted relatively thereto.

The thrust unit 104, as shown in FIG. 13, is so connected in the hydraulic system as to be subject to the pressure of the pressure fluid within the pressure chamber 30. The inlet port 89 is connected on the low pressure side of the pressure control valve 79, connected to the solenoid valve 78. The drain port 90 communicates with the reservoir 35. While the valve 87 tends to reduce pressure downstream of the pressure control valve 79, it remains closed until the force of the spring 96 is overcome. Thus, under initial conditions, the maximum thrust pressure in the thrust units has a minimum value, but as the pressure builds up in the pressure chamber 30, the load on the spring 96 increases, increasing the maximum pressure exerted by the thrust units 21 so that the pressure, in effect, is augmented in proportion to the increased clamping requirements due to the increased pressure of the pressure fluid. By adjusting the angular position of the thrust unit 104, the amount of compensating force may be adjusted.

Operation of the means for shaping sheet metal is as follows:

Initially, the ring of slide bars 27 are retracted and the backing plate 5 is in its lower position, indicated by dotted lines in FIG. 2. Also, the clamping ring 7 is removed. The sensing or probe strips 41 are retracted by means not shown, forming a part of the master and slave control assemblies 43 and 44. A flat, circular work piece 8 dimensioned to fit within the mounting ring 1 is placed on the backing plate 5, the clamping ring 7 is placed on the work piece. The slide bars 27 are extended radially inward to overlie the clamping ring, and initial pressure is applied to the thrust units 21 of the clamping units. The sensing strips 41 are extended into contact with the edge of the work piece. A predetermined maximum pressure is applied to the thrust units of the clamping units, corresponding to the slave control assemblies 44 and the lesser pressure is supplied to the group of clamping units associated with the master control assembly 43 by adjustment of the pressure control valves 79, 84 and 86.

Pressure fluid is then applied at a controlled rate and pressure to the pressure chamber 30 formed between the backing plate 5 and the work piece 8. As the central portion of the work piece distends, that portion of the margin held by the clamping units related to the master control assembly 43 tends to contract or slide due to the fact that the back pressure in these thrust units is higher, resulting in a lesser clamping force. Predetermined slight initial movement of the margin of the work piece in this region causes a similar movement in the slave control assemblies 44, to activate the switches 51 in a manner to relieve pressure in the corresponding thrust units until slippage has occurred corresponding to that occurring in the region controlled by the master control assembly 43. This intermittent operation continues until the limit switch 53 is closed, causing the back pressure in all of the clamping units to be relieved, and locking the margin of the work piece against further slidmovement.

During the forming of the work piece, the augmenting valve 87 increases the effective clamping force to compensate for increased pressure within the pressure chamber 30.

The forming operation may terminate with the operation of the limit switch 59, shown in FIG. 4, or may continue throughout the forming operation under control of the probe 60, shown in FIG. 11.

By reason of the fact that the forming operation may, if desired, take place relatively slowly, the work piece may be maintained rather accurately at a desired temperature. More specifically, the work piece may be heated to a substantial temperature, if need be, by using pressure liquid capable of withstanding the desired temperature, or even by the use of pressure liquids which are solids at normal temperature. Conversely, some materials are more workable at reduced temperatures, even in the cryogenic range. In such case, the pressure fluid may be one of the gases chilled to its liquid state, such as helium or hydrogen. In this case, a separate pump and reservoir are used for the cryogenic pressure liquid, or the extra high temperature pressure liquid.

While the present means and method of forming sheet metal is applicable to metals which are readily formed, and to work pieces of relatively small dimension, both the means and method are primarily directed to the forming of pieces of large size; that is, several feet or many feet in diameter. In fact, it is contemplated that a work piece as much as 200 feet in diameter may be formed by the herein described means and method. In order to provide a work piece of such large dimension, smaller pieces are, of course, welded together. The technique of automatically welding such pieces and preparing the junctures between such pieces so as to be as strong as the connected pieces is available. It is not essential that the work piece be circular in form. Furthermore, it need not be dome-shape; that is, its distended contour may be asymmetrical.

In the forming of products of large size, it is contemplated to use opposed clamping rings of the desired dimension and shape, a backing sheet which will distend in opposition to the work piece, and to provide a ring of independent, removable clamping structures.

Figure 14:
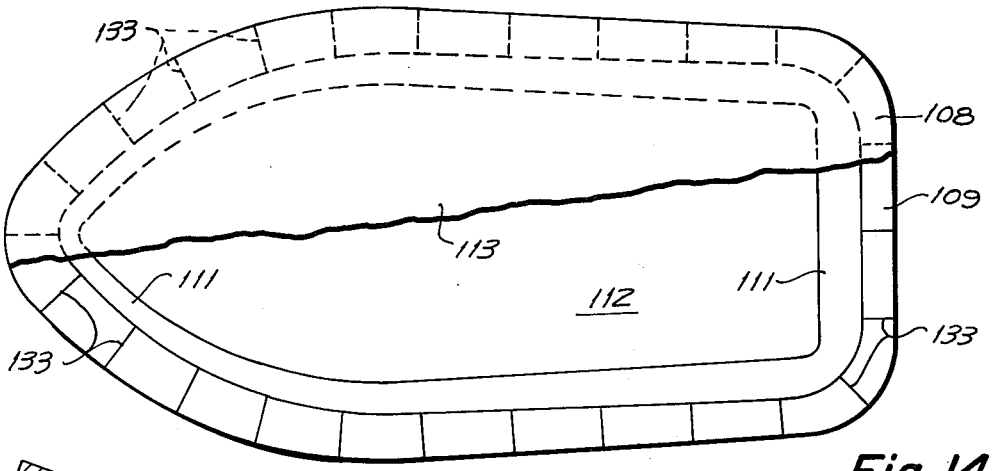
FIG. 14 is a plan view, at reduced scale, illustrating a modified embodiment of the sheet metal forming means, as adapted to work pieces of large size and of asymmetrical shape.
Figure 15:
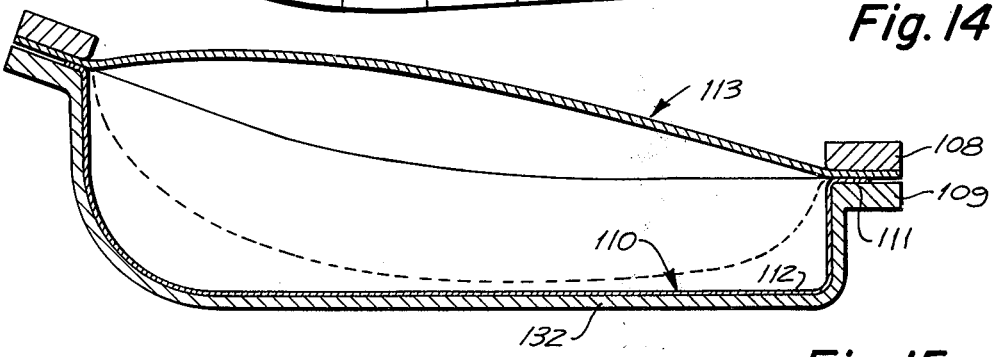
FIG. 15 is a longitudinal sectional view thereof, taken through 15—15 of FIG. 14, indicated by dotted lines a partially distended condition of a work piece.
Figure 16:
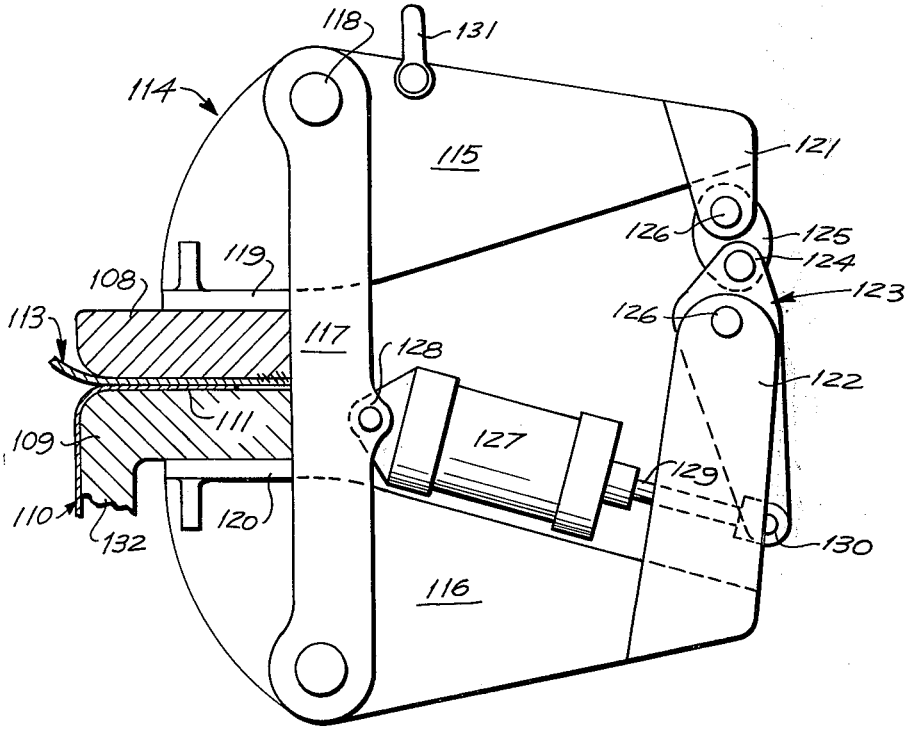
FIG. 16 is a side view of a clamping unit for use in conjunction with the embodiment shown in FIGS. 14 and 15, and indicating fragmentarily and by section the clamping flanges, the work piece and its backing member.

More particularly, in this regard, reference is directed to FIGS. 14, 15 and 16. For purposes of illustration, but not limitation, the means and method here shown is directed to the forming of a sheet metal boat hull. A pair of opposed clamping rings 108 and 109, delineating the shape of the product is provided. The clamping rings clamp therebetween a work piece 110, indicated in its finished form, that is, having a flange 111 and a distended portion 112. The work piece is backed by a backing membrane 113, which may be sheet metal identical to the work piece, but preferably of somewhat greater thickness; that is, the membrane may be distendable, but not to the degree required of the work piece and may be reused.

The opposed clamping rings 108 and the margins of the work piece 110 and 113 are clamped by a series of clamping structures 114. The clamping structures are placed relatively close together about the entire periphery of the clamping rings. In fact, if the size of the product requires several hundred clamping structures may be used. Each clamping structure includes a pair of opposed clamping levers 115 and 116, joined by a pair of connecting links 117, and pivot pins 118. One end of each clamping lever extends a short distance laterally of the connecting links and the confronting portions of the two levers are provided respectively with clamping jaws 119 and 120.

The opposite ends of the clamping levers extend a substantial distance from the connecting links 117 and are provided with clevis extensions 121 and 122, respectively, which extend toward each other. The clevis extension 122 is longer than the clevis extension 121 and is provided with a lever 123, having a short lever arm 124, joined by a link member 125 to the other clevis extension 121, the parts being pivotally connected by pivot pins 126.

Extending between the connecting links 117 and the clevis extension 121 is a thrust unit 127, which may be hydraulic or pneumatically operated, preferably however, a pressure liquid rather than a pressure gas is used. The hydraulic unit 127 is joined between the connecting links by a pivotal connection 128. The thrust unit 127 includes a thrust shaft 129, joined by a pivotal connection 130 to the longer arm of the lever 123. Each clamping structure is provided with a suspension clevis 131 so that it may be manipulated into and out of its operating position.

In order to minimize the amount of movement required of the clamping jaws 119, and the ensure relatively uniform clamping force, the transverse dimensions of the clamping rings 108 and 109 as well as the thickness of the work piece 110 and the backing membrane 113 are held to relatively close limits. This is also true of the clamping jaws 119 and 120 and the connecting links 117. As a result, a relatively small thrust unit 127 is capable, through the leverage provided, to exert a dependable clamping force. Reasonable tolerance is permitted, however, as the angular position of the lever 123 may vary when the structure is in its clamping position, such as shown in FIG. 16. Also, by reason of the large number of clamping structures used, when these are placed side-by-side about the clamping rings causes the force on the clamping rings to be averaged.

In the construction shown, the clamping ring containing the work piece is shown as provided with a die shell 132, suggesting that the work piece may be formed in a single operation. However, it is also contemplated that the product may be formed in two stages, as described in connection with the embodiment shown in the previous figures.

With regard to the backing membrane, it is constructed to have, for instance, twice the strength of the work piece. It will distend in opposition to the work piece a distance less than the distention of the work piece and once it has distended, it will tend to reach a condition of substantial equilibrium and may be used repeatedly.

It is contemplated that the effective pressure in the thrust units 127 will be controlled in the manner described in connection with the preceding embodiment and that the margins or flange 111 of the work piece will be permitted to slide relative to the clamping rings. However, the amount of sliding movement at different parts in the periphery of the work piece will vary according to the departure of the product from a symmetrical shape. Thus, for example, in the forming of a boat hull, more slippage may be required in the bow portion than in the stern portion, as indicated by the radial lines 133 of different lengths in FIG. 14. Each of these lines may represent the rotation of a sensing or probe strip 41 and a control assembly. Inasmuch as the inward movement of each portion of the periphery of the blank may be predicted, the control assemblies are electrically interconnected to an appropriate electrically operated program control, analagous to the mechanical control illustrated in FIG. 12.

The method of forming sheet metal is summarized as follows:

A sheet metal work piece is placed on a coextensive disc or membrane, or conversely, such disc or membrane is placed over the work piece. One or more clamping rings are placed over and under the margin of a work piece, or if the backing disc is of sufficient thickness, its margin may serve as a clamping ring. A plurality of clamping units are arranged about the clamping rings in closely spaced relation. The clamping units may be fixed relative to each other, or may constitute individual separately positionable clamping units. The margin of the work piece is held in sealed relation with the corresponding margin of the backing disc or membrane, to form therewith a pressure chamber. Pressure fluid, preferably a liquid, but which in some cases may be a gas, is introduced into the pressure chamber, preferably at a plurality of points adjacent the periphery of the work piece. An outlet for the pressure fluid is provided, which is throttled to permit buildup of pressure in the pressure chamber while permitting circulation of the pressure fluid.

Depending upon the properties of the work piece and the shape of the resulting product, the pressure fluid may be heated or cooled so as to transmit its temperature to the work piece. The pressure fluid is applied with increasing pressure to cause the work piece to distend from the backing disc or membrane initially without restraint except that provided by the work piece itself.

During the distention of the work piece, the clamping pressure about the periphery of the work piece is controlled to permit a predetermined slippage of the margin of the work piece with respect to the clamping rings. Such slippage may be uniform about the periphery of the work piece, or may be greater in one region with respect to another. Such slippage is controlled by sensing the inward movement or slippage of the margin of the work piece and utilizing the information to control the pressure exerted by the selected clamping units.

The distention of the work piece to its finished configuration may take place in a single operation, or, the work piece may be distended a predetermined amount after which a clamping ring of larger dimension forming the margins of a die shell may be substituted and secured by the clamping units, whereupon pressure fluid is again applied to force the work piece into conformity with the die shell.

During the course of distending the work piece, the extent of movement of the work piece may be probed and the information utilized to control the rate and pressure exerted by the pressure fluid, thereby to control the rate of distention of the work piece.

In order to control the shape of the finished piece, the initial thickness of the work piece may vary, as more fully described in U.S. Pat. No. 3,339,311.

While particular embodiments of this invention have been shown and described, it is not intended to limit the same to the details of the constructions set forth, but instead, the invention embraces such changes, modifications and equivalents of the various parts and their relationships as come within the purview of the appended claims.

I claim:

1. Means for shaping sheet metal, comprising:

a. a pair of opposed marginal members for receiving the margin of a sheet metal work piece therebetween;

b. a backing member for the work piece joined to one of the marginal members and forming with the work piece a pressure chamber;

c. guide means confronting the outer periphery of the marginal members and permitting translational movement of the marginal members and work piece as a unit relative thereto;

d. a plurality of clamp units disposed about the marginal members, each clamp unit including the guide means, a pair of opposed clamp members relatively movable to clamp the marginal members and the work piece therebetween, and means for effecting relative movement of the clamp members;

e. means for introducing pressure fluid into the pressure chamber to distend the work piece with respect to the backing member; and f. means for individually controlling the clamping force exerted by each clamp unit to permit controlled slippage of the margin of the work piece with respect to the marginal members; including means for sensing slippage of the work piece in selected regions.

2. Means for shaping sheet metal, as defined in claim 1, wherein;

a. a ring structure surrounds the marginal members, includes the guide means and forms a common support for the clamp units;

b. each clamp unit includes a first clamping member carried by the ring structure for engagement with one of the marginal members to limit movement of the marginal members and work piece with respect to the guide means; and a second clamping member movable toward the first clamping member thereby to clamp the marginal members and work piece.

3. Means for shaping sheet metal, as defined in claim 1, wherein:

a. each clamp unit is independent of the other clamp units and is adapted to be placed individually in outwardly extending position with their respective guide means in confronting relation to the marginal members and their clamp members in position for engagement with the opposed surfaces of the marginal members.

4. Means for shaping sheet metal, as defined in claim 1, wherein:

a. the backing member is formed of sheet material of greater strength than the work piece and tends in response to pressure in the pressure chamber to distend in the opposite direction from the work piece and to a lesser extend.

5. Means for shaping sheet metal, as defined in claim 1, wherein:

a. the inner periphery of the second marginal member opposite from the backing member, defined the peripheral boundary of the distended work piece;

b. and an additional marginal member having a larger inner periphery than the second marginal member is adapted to be substituted therefor, for further peripheral expansion of the work piece.

* * * * *